US005406668A

United States Patent [19]

Goodhue

[11] Patent Number: 5,406,668

[45] Date of Patent: Apr. 18, 1995

[54] PAINTBRUSH WITH A BUILT-IN HOLDER

[76] Inventor: Gordon A. Goodhue, 85-125 C Ala Akau St., Waianae, Hi. 96792

[21] Appl. No.: 210,428

[22] Filed: Mar. 21, 1994

[51] Int. Cl.[6] ..... A46B 15/00

[52] U.S. Cl. ..... 15/159.1; 15/143.1; 248/110; 248/685

[58] Field of Search ..... 15/143.1, 159.1, 246; 248/110, 213.2, 685, 691

[56] References Cited

U.S. PATENT DOCUMENTS

| | | | |
|---|---|---|---|
| 888,896 | 5/1908 | Howard | 15/246 |
| 1,206,010 | 11/1916 | MacKeever | 248/685 |
| 1,215,052 | 2/1917 | Nelson | 248/685 |
| 1,228,774 | 6/1917 | Hecht | 248/685 |
| 1,277,019 | 8/1918 | Wright | 248/685 |
| 1,312,178 | 8/1919 | Hill | 248/685 |
| 1,328,162 | 1/1920 | Hecht | 248/691 |
| 2,273,642 | 2/1942 | Henderson | 15/143.1 |
| 2,309,990 | 2/1943 | Savi | 15/246 |
| 3,231,919 | 2/1966 | MacDonald | 15/246 |
| 3,612,464 | 10/1971 | Harrah | 248/685 |
| 3,874,021 | 4/1975 | Jacobs | 15/143.1 |

*Primary Examiner*—Mark Spisich
*Attorney, Agent, or Firm*—Michael I. Kroll

[57] ABSTRACT

A paintbrush with a built-in holder is provided, which consists of a heel portion, a handle extending from the heel portion, a plurality of bristles and a ferrule for retaining the bristles to the heel portion. A structure is in the handle for supporting the paintbrush in a paint bucket, so that the bristles are elevated above the paint within the paint bucket.

6 Claims, 2 Drawing Sheets

PAINTBRUSH WITH A BUILT-IN HOLDER

BACKGROUND OF THE INVENTION

1. Field of the Invention

The instant invention relates generally to paint applicator hangers and more specifically it relates to a paintbrush with a built-in holder.

2. Description of the Prior Art

Numerous paint applicator hangers have been provided in prior art. For example, U.S. Pat. No. 1,289,171 to Hilton; U.S. Pat. No. 1,313,515 to Caffrey; 1,328,162 to Hecht; U.S. Pat. No. 1,713,077 to Frizl; U. S. Pat. No. 3,231,919 to MacDonald and U.S. Pat. No. 5,044,038 to Matkovic all are illustrative of such prior art. While these units may be suitable for the particular purpose to which they address, they would not be as suitable for the purposes of the present invention as heretofore described.

Hilton, George A.

BRUSH HANGER

U.S. Pat. No. 1,289,171

A brush hanger having means at one end for pivotal attachment to a brush, and having a hook at the other end. The back of the hook is of a form adapted to closely embrace the adjacent parts of the brush handle when folded back.

Caffrey, Peter C.

BRUSH

U.S. Pat. No.1,313,515

A brush having a one-piece hook secured thereto. The hook is pivoted to swing on an axis parallel with the bristles.

Hecht, Charles E.

BRUSH HOLDER

U.S. Pat. No. 1,328,162

In a brush, the combination of a head having a recess in its upper surface, a metal socket piece mounted in the recess and having a lip portion bent to extend along an edge surface of the head. The socket piece having pivot means therein, and a resilient hooked member bent into loop form, loosely pivoted on the pivot means. The hook thereof is adapted to be forced over the lower edge of the lip portion, when the main portion of the hooked member is compressed within the socket piece.

Frizl, Frank

PAINTBRUSH HOLDER

U.S. Pat. No. 1,713,077

A paintbrush holder comprising a wire formed into a loop. The end of the loop bent downwardly for engagement over the edge of a paint bucket. Hinge members are on the shank of the paintbrush laterally extending portions are on the other end of the loop and pass through the hinge members. Means extending into a recess in the shank is for limiting the extent of oscillation of the holder and permit the same to swing upwardly to a substantially horizontal position.

MacDonald, Winfred A.

PAINTBRUSH

U.S. Pat. No. 3,231,919

A paintbrush having a ferrule of thin sheet metal connecting the handle and bristles thereof. The ferrule presents a substantially flat area having therein the scored outline of a tongue in the shape of a flat hook lying flush in the ferrule. A narrow waist and rounded head, and a rounded transverse corrugation in the ferrule define a fold vertex about which the hook may be forcibly bent out of the plane of the ferrule. The end of the hook is free from connection with the rest of the ferrule, so that it may be engaged and pried out of its initial flush relation in the flat area of the ferrule.

Matkovic, Zvonko

FOLDABLE PAINTBRUSH HOOK ASSEMBLY

U.S. Pat. No. 5,044,038

A foldable hook assembly for a paintbrush is described. A hook is foldable laterally on a body of the brush, so as to be out of the way when the brush is used for painting.

SUMMARY OF THE INVENTION

A primary object of the present invention is to provide a paintbrush with a built-in holder that will overcome the shortcomings of the prior art devices.

Another object is to provide a paintbrush with a built-in holder in which an arm is retained in a first position within a recess in a handle of the paintbrush when not in use, so that the handle can be normally gripped by a hand of a person using the paintbrush.

An additional object is to provide a paintbrush with a built-in holder in which the arm can be pivoted at an angle outwardly from the recess in the handle in a second position, so that the paintbrush can be supported on a paint bucket to elevate the bristles of the paintbrush above paint within the paint bucket.

A further object is to provide a paintbrush with a built-in holder that is simple and easy to use.

A still further object is to provide a paintbrush with a built-in holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
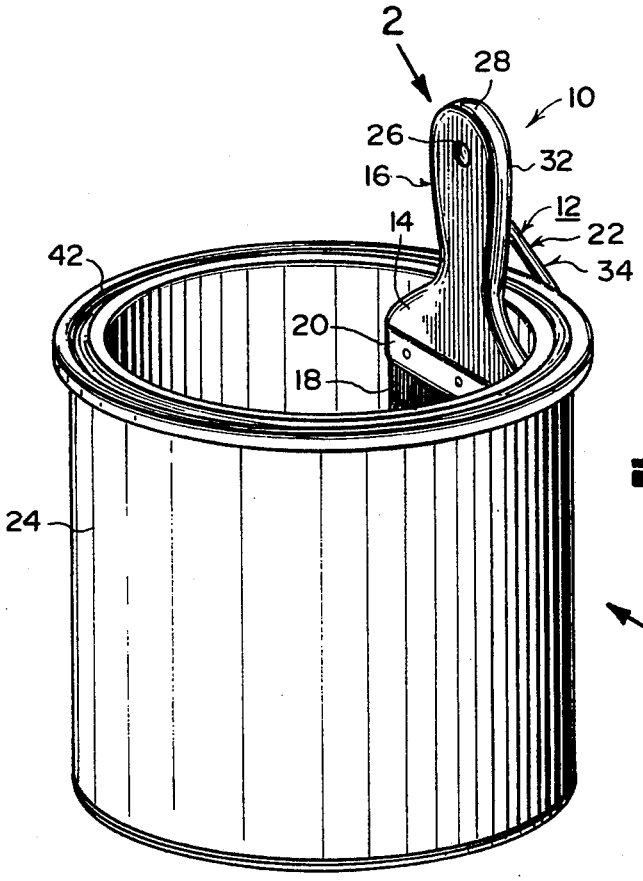
FIG. 1 is a front perspective view of the instant invention suspended on a lip of a paint bucket.
Figure 2:
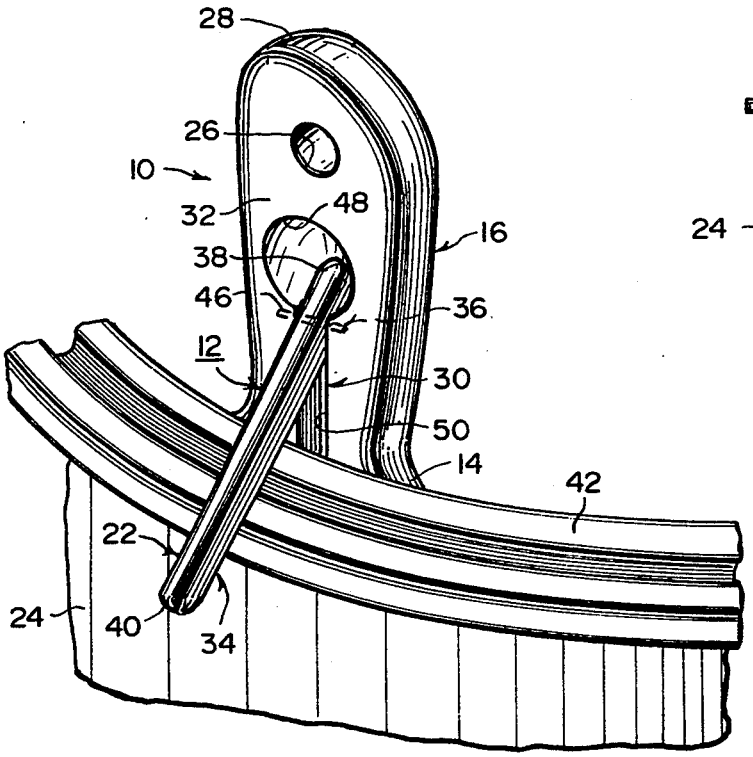
FIG. 2 is a rear perspective view taken in the direction of arrow 2 in FIG. 1, with the paint bucket broken away.
Figure 3:
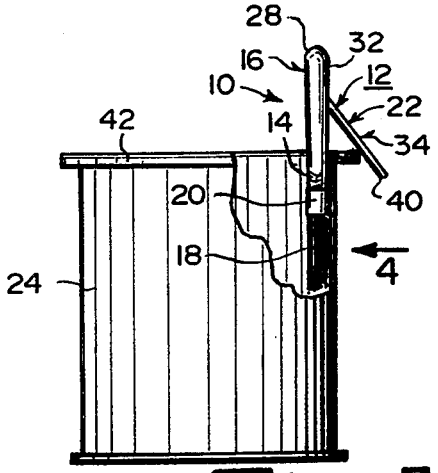
FIG. 3 is a side view taken in the direction of arrow 3 in FIG. 1, with the paint bucket broken out.
Figure 4:
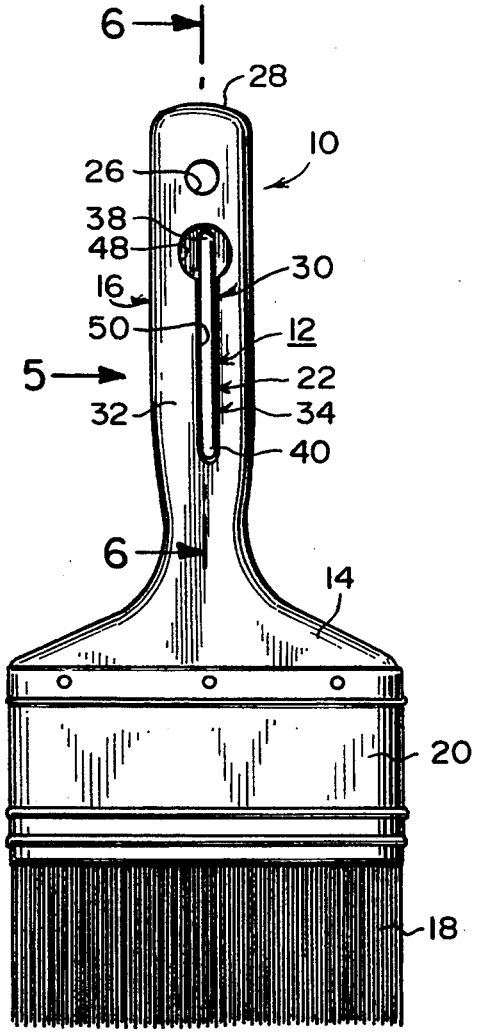
FIG. 4 is a rear view of the instant invention per se, taken in the direction of arrow 4 in FIG. 3.
Figure 5:
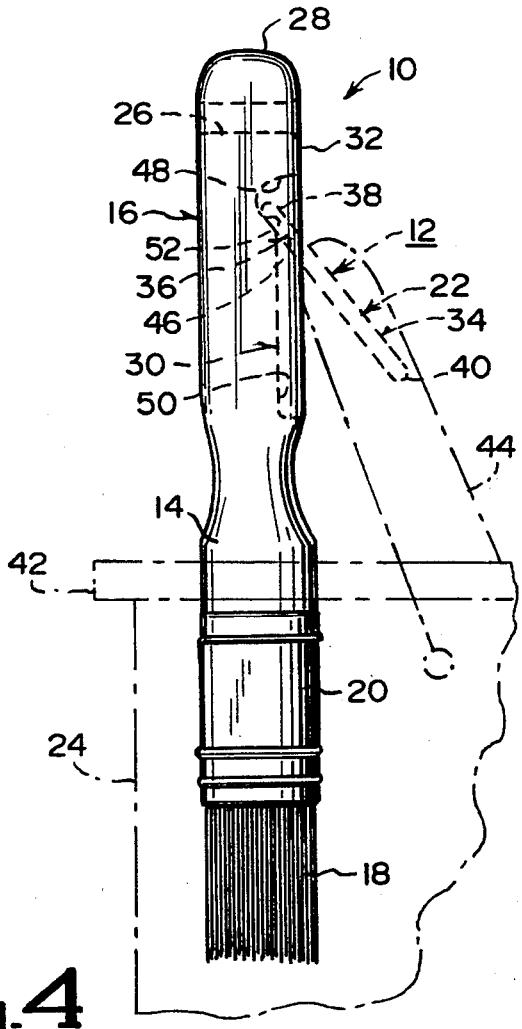
FIG. 5 is a side view taken in the direction of arrow 5 in FIG. 4, showing in phantom the instant invention suspended on a wire handle of the paint bucket.
Figure 6:
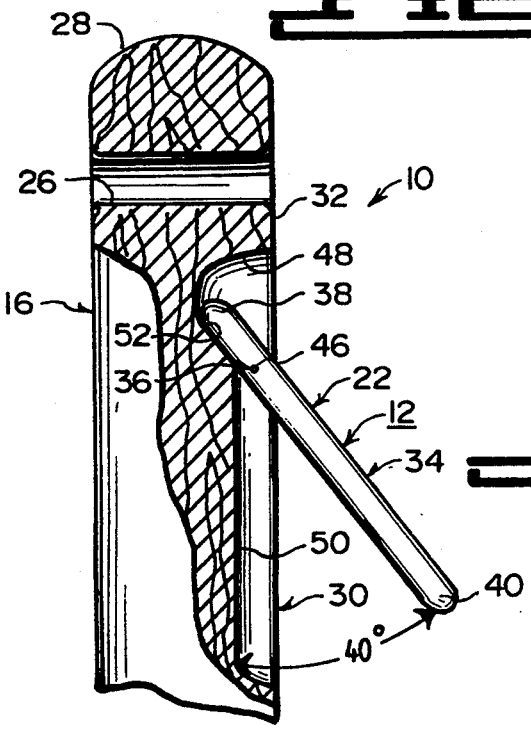
FIG. 6 is an enlarged cross sectional view of the handle taken long line 6—6 in FIG. 4, showing the arm and recess therein in greater detail.

Turning now descriptively to the drawings, in which similar reference characters denote similar elements throughout the several views, FIGS. 1 through 6 illustrate a paintbrush 10 with a built-in holder 12, which consists of a heel portion 14, a handle 16 extending from the heel portion 14, a plurality of bristles 18 and a ferrule 20 for retaining the bristles 20 to the heel portion 14. A structure 22 is in the handle 16, for supporting the paintbrush 10 in a paint bucket 24, so that the bristles 18 are elevated above the paint within the paint bucket 24.

The handle 16 further has a transverse aperture 26 therethrough at its distal free end 28. The handle 16 with the transverse aperture 26 can be hung upon a horizontal projection, when the paintbrush 10 is to be stored when not in use.

The supporting structure 22 includes a longitudinal recess 30 formed into one side 32 of the handle 16. An elongated arm 34 is provided. A component 36 is for pivotally mounting a first end 38 of the arm 34 with the recess 30 in the handle 16 opposite from the heel portion 14. In a first position, the arm 34 will rest flush within the recess 30. In a second position, a second end 40 of the arm 34 will extend outwardly at an angle from the recess 30. The arm 34 in the second position can in a first instance hook onto a lip 42 of the paint bucket 24, and in a second instance hook onto a wire handle 44 of the paint bucket 24.

The pivotally mounting component 36 is a pin 46 extending transversely through the arm 34 adjacent the first end 38 and transversely through the recess 30 in the handle 16. The arm 34 can pivot on the pin 46 within the recess 30.

The recess 30 contains an enlarged opening about the first pivotable end 38 of the arm 34. An object, such as a finger, can be inserted into the enlarged opening 48 and press against the first pivotable end 38, to cause the second end 40 of the arm 34 to extend outwardly at an angle from the handle 16.

An elongated narrow slot 50 extends from the enlarged opening 48 towards the heel portion 14. When the arm 34 is in the fist position, the arm 34 below the first pivotable end 38 will lie flush within the elongated narrow slot 50 when not in use.

The recess 30 includes an angled stop portion 52 at the junction between the enlarged opening 48 and the narrow slot 50. When the finger is pressed against the first pivotable end 38 of the arm 34, the arm 34 will automatically extend outwardly at a proper angle from the handle 16.

The angled stop portion 52 is at an angle of forty degrees, so that when the finger is pressed against the first pivotable end 38 of the arm 34, the first pivotable end 38 will stop at the angled stop portion 52 with the arm 34 always extending outwardly at an angle of forty degrees from the handle 16.

The heel portion 14 and the handle 16 are fabricated out of a durable strong material, such as wood, plastic and metal. The arm 34 and the pin 46 are also fabricated out of a durable strong material, such as wood, plastic and metal.

OPERATION OF THE INVENTION

To use the paintbrush 10 with the built-in holder 12 the following steps should be taken:

1. Press the first end 38 of the arm 34 inwardly within the enlarged opening 40 in the recess 30.
2. Make sure that the first end 38 of the arm 34 engages with the angled stop portion 52 in the recess 30.
3. The arm 34 will extend outwardly from the elongated narrow slot 50 of the recess 30 at an angle of forty degrees.
4. Hook the arm 34 onto the lip 42 of the paint bucket 24, so that the bristles 18 will hang down within the paint bucket 24 above the paint.
5. Hook the arm 34 onto the wire handle 44 of the paint bucket 24 if there is too much paint within the paint bucket 24, for this will raise the bristles 18 higher above the paint.
6. Remove the arm 34 from the paint bucket 24, when the paintbrush is no longer needed for painting.
7. Press the arm 34 back into the elongated narrow slot 50, so that the handle 16 can be used in a normal fashion or hung up on horizontal projection with the transverse aperture 26.

LIST OF REFERENCE NUMBERS

10 paintbrush
12 holder
14 heel portion of 10
16 handle of 10
18 bristles of 10
20 ferrule of 10
22 supporting structure for 12
24 paint bucket
26 transverse aperture in 16
28 distal free end of 16
30 longitudinal recess
32 one side of 16
34 elongated arm
36 pivotally mounting component
38 first end of 34
40 second end of 34
42 lip of 24
44 wire handle of 24
46 pin for 36
48 enlarged opening in 30
50 elongated narrow slot in 30
52 angled stop portion in 30

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A paintbrush with a built-in holder which comprises:

a) a heel portion;

b) an elongated handle having two ends with one of said ends being fixed to and extending from said heel portion and the other of said ends being a distal free end, said handle further having a transverse aperture therethrough at said distal free end, so that said handle with said transverse aperture can be hung upon a horizontal projection when said paintbrush is to be stored when not in use;

c) a plurality of bristles;

d) a ferrule for retaining said bristles to said heel portion; and e) means in said handle for supporting said paintbrush in a paint bucket, so that said bristles are elevated above the paint within said paint bucket, said supporting means including a longitudinal recess formed into a one side of said handle, an elongated arm, and means for pivotally mounting a first end of said arm within said recess in said handle opposite from said heel portion, so that in a first position said arm will rest flush within said recess and in a second position a second end of said arm will extend outwardly at an angle from said recess, so that said arm in the second position can in a first instance hook onto a lip of the paint bucket and in a second instance hook onto a wire handle of the paint bucket, said pivotally mounting means being a pin extending transversely through said arm adjacent said first end and transversely through said recess in said handle, so that said arm can pivot on said pin within said recess, said recess containing an enlarged opening about said first pivotable end of said arm, so that an object, such as a finger, can be inserted into said enlarged opening and press against said first pivotable end, to cause said second end of said arm to extend outwardly at an angle from said handle.

2. A paintbrush with a built-in holder as recited in claim 1, wherein said recess includes an elongated narrow slot extending from said enlarged opening towards said heel portion, so that when said arm is in the first position, said arm below said first pivotable end will lie flush within said elongated narrow slot when not in use.

3. A paintbrush with a built-in holder as recited in claim 2, wherein said recess includes an angled stop portion at the junction between said enlarged opening and said narrow slot, so that when the finger is pressed against said first pivotable end of said arm, said arm will automatically extend outwardly at a proper angle from said handle.

4. A paintbrush with a built-in holder as recited in claim 3, wherein said angled stop portion is at an angle of forty degrees with respect to said slot, so that when the finger is pressed against said first pivotable end of said arm, said first pivotable end will stop at said angled stop portion with said arm always extending outwardly at an angle of forty degrees from said handle.

5. A paintbrush with a built-in holder as recited in claim 4, wherein said heel portion and said handle are fabricated out of a durable strong material.

6. A paintbrush with a built-in holder as recited in claim 5, wherein said arm and said pin are fabricated out of a durable strong material.

* * * * *